US007883367B1

(12) United States Patent
Kline

(10) Patent No.: US 7,883,367 B1
(45) Date of Patent: Feb. 8, 2011

(54) HIGH DENSITY BACKPLANE CONNECTOR HAVING IMPROVED TERMINAL ARRANGEMENT

(75) Inventor: Richard Scott Kline, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/460,760

(22) Filed: Jul. 23, 2009

(51) Int. Cl.
*H01R 13/648* (2006.01)

(52) U.S. Cl. ..... 439/607.05; 439/607.09

(58) Field of Classification Search ..... 439/607.05, 439/607.06, 607.07, 607.09, 607.11, 607.13
See application file for complete search history.

(56) References Cited

U.S. PATENT DOCUMENTS 6,293,827 B1 * 9/2001 Stokoe ..... 439/607.07
6,409,543 B1 * 6/2002 Astbury et al. ..... 439/607.07
6,503,103 B1 1/2003 Cohen et al.
6,979,226 B2 * 12/2005 Otsu et al. ..... 439/607.07
7,229,318 B2 6/2007 Winings et al.
7,390,218 B2 6/2008 Smith et al.
7,674,133 B2 * 3/2010 Fogg et al. ..... 439/607.07
7,736,182 B2 * 6/2010 Pan ..... 439/607.07
2003/0003803 A1 * 1/2003 Billman et al. ..... 439/608
2009/0068887 A1 * 3/2009 Ito ..... 439/608

* cited by examiner

*Primary Examiner*—Hae Moon Hyeon
(74) *Attorney, Agent, or Firm*—Ming Chieh Chang; Wei Te Chung; Andrew C. Cheng

(57) ABSTRACT

A high density backplane connector (100) includes a group of terminal pairs (17, 18, 27, 28) arranged along a first direction. Each terminal pair includes a first terminals (12, 22) and a second terminals (14, 24) substantially aligned with each other along a second direction perpendicular to the first direction. The first terminal has a first engaging portion (124, 224) and a first tail portion (125, 225). The second terminal has a second engaging portion (144, 244) extending beyond the first engaging portion and a second tail portion (145, 245). The first and second tail portions of the terminal pairs are arranged substantially in a line.

20 Claims, 12 Drawing Sheets

HIGH DENSITY BACKPLANE CONNECTOR HAVING IMPROVED TERMINAL ARRANGEMENT

CROSS-REFERENCE TO RELATED APPLICATIONS

This patent application is related to a pending U.S. patent application Ser. No. 12/148,757, filed on Apr. 22, 2008, and entitled "HIGH DENSITY CONNECTOR HAVING TWO-LEVELED CONTACT INTERFACE", which is assigned to the same assignee with this application.

BACKGROUND OF THE INVENTION

1. Field of the Invention

The present invention relates to an electrical connector, and particularly to a high density backplane connector in which contact engaging portions of a male connector are arranged in first and second columns, and while a mating intersection of a receptacle connector is also arranged in first and second columns corresponding to the second and first columns of the contact engaging portions, respectively.

2. Description of Related Art

Backplane connector is generally configured with a wafer on which about four contacts, say first, second, third and fourth contacts are arranged in a single plane. For explanation, the first contact will referred to the contact closer to a motherboard, while the fourth contact will be the contact most distant to the mother. Since those four contacts are generally arranged in right-angle, the overall length of those four contacts vary accordingly, i.e. the first contact has the shortest overall length, while the fourth contact has the longest overall length. As a result, a single skew will be encountered. The same applies to a differential pairs are well since the contact lengths are different from each other within the pairs when it is arranged in right-angle.

The right angle configuration of the typical backplane connector provides variable lengths in signal transmission paths. The paths go from shortest to longest as contacts move further away from the component side of the daughter board. Signal launched at the same time would arrive at different times at the far end of the connector due to the difference in length, or skew, of the transmission paths. In a differential pair configuration, this difference in length, or skew, must be compensated for and is typically handled by the printed circuit board (PCB) designer. Some connectors are designed to provide skew compensation by adding air in the areas where the transmission paths bend on the longer path of the two paths within the differential pair. This allows the signal to travel faster around the bends of the longer path in an attempt to get the signals to arrive at the same time at the far end. The typical connector is described either in U.S. Pat. No. 7,229,318 issued to Winings et al. on Jun. 12, 2007 or U.S. Pat. No. 7,390,218 issued to Smith et al. on Jun. 24, 2008.

However, this method would have a detrimental effect impedance and increased crosstalk.

SUMMARY OF THE INVENTION

An object of the present invention is to provide a high density backplane connector having improved effect of reducing crosstalk by providing substantially equal signal transmission paths among the contacts.

To achieve the aforementioned objects, a high density backplane connector includes a group of terminal pairs and a group of contact pairs arranged along a first direction. Each terminal pair includes a first terminal and a second terminals substantially aligned with each other along a second direction perpendicular to the first direction. The first terminal has a first engaging portion and a first tail portion. The second terminal has a second engaging portion and a second tail portion. The first and second tail portions of the terminal pairs disposed in a line and designated as signal-signal-ground sequence. The contact pairs include a first and a second contacts substantially aligned with each other along the second direction. The first contact has a first tail portion and a first contact portion in contact with the second engaging portion of the second terminal. The second contact has a second tail portion and a second contact portion in contact with the first engaging portion of the first female terminal. The first and second tail portions of the contact pairs disposed in a line. A length of the first terminal plus a length of a corresponding mated second contact is substantially equal to a length of the second terminal plus a length of a corresponding mated first contact.

Signals transmitted through the first transmission path of the second contact and the first terminal, and the second transmission path of the first contact and the second terminal. Designing the twist transmission paths within the wafer or dielectric support allows signals travel through the high density backplane connector synchronously. It helps to reduce crosstalk by eliminating skew on the terminals or the contacts.

Other objects, advantages and novel features of the invention will become more apparent from the following detailed description of a preferred embodiment when taken in conjunction with the accompanying drawings.

DETAILED DESCRIPTION OF THE INVENTION

Figure 1:
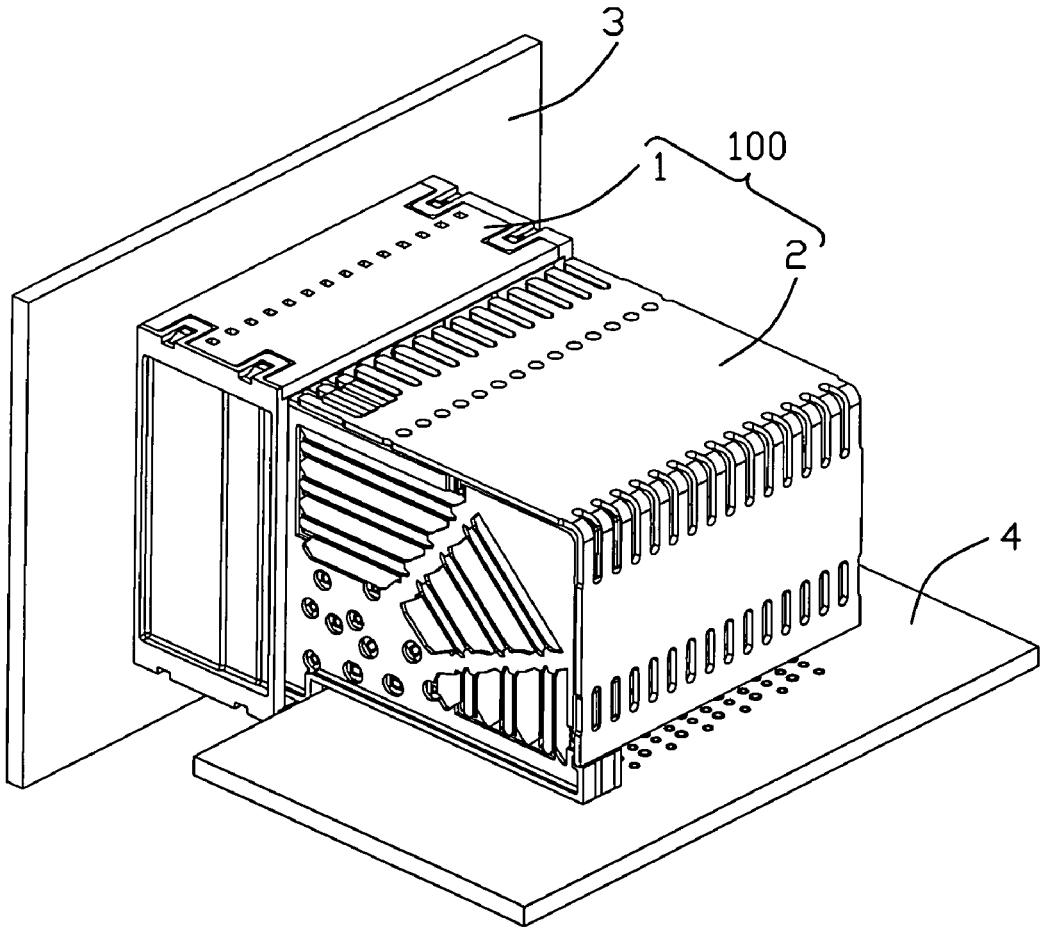
FIG. 1 is an assembled perspective view of a high density backplane connector mounted on a mother board and a daughter board in accordance with the present invention.

Reference will now be made to the drawing figures to describe the present invention in detail. Referring to FIG. 1, a high density backplane connector 100 in accordance with the preferred embodiment of the present invention comprises a first connector 1 connected with a mother board 3 via press-fit technology, and a second connector 2 connected to a daughter board 4 orthogonal to the mother board 3 via press-fit technology. The first connector 1 is adapted for mating with the second connector 2 to establish an electrical connection between the mother board 3 and daughter board 4. The first connector 1 is shown as a female connector in view of its housing structure and will be so called in the following description. Similarly, since the second connector 2 is shown as a male connector in view of its interface housing structure, it will be so called in the following description for ease of reference and clarity, but not in the sense of limiting.

Figure 11:
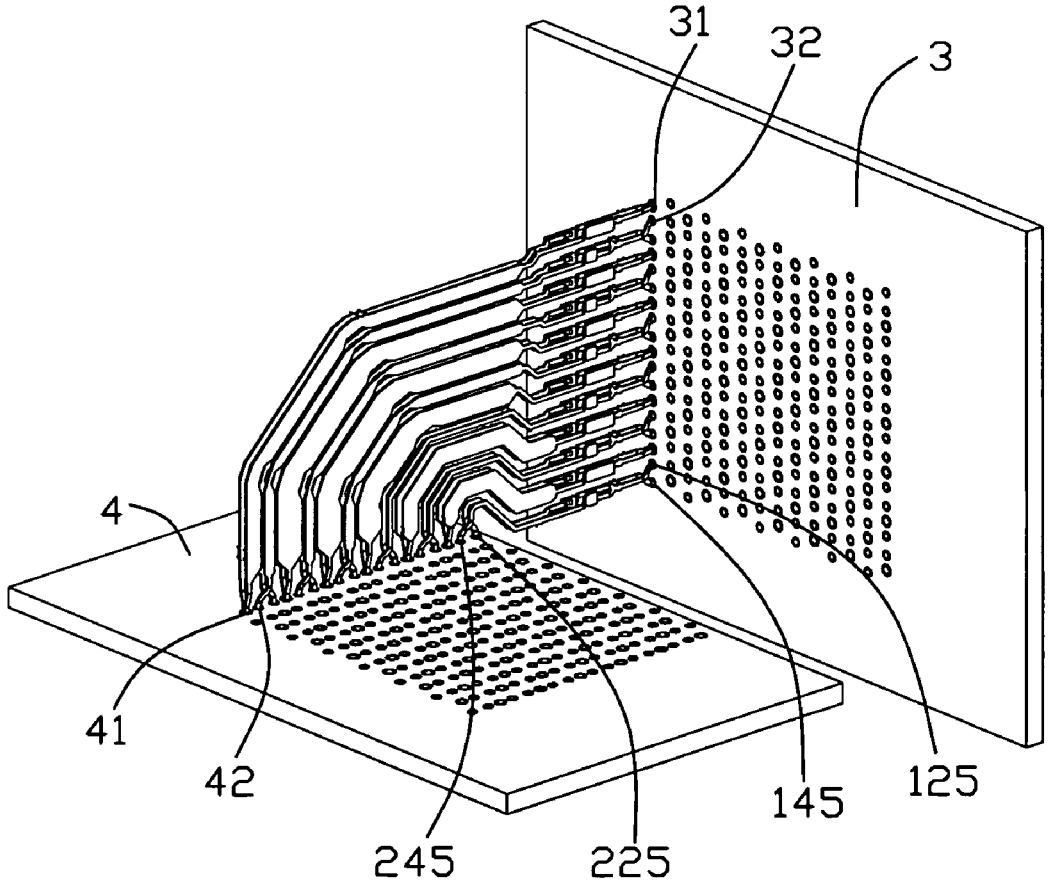
FIG. 11 is a schematic view showing the engagement between the female terminals and the mother board, and the engagement between the male contacts and the daughter board.

Referring to FIG. 11, the mother board 3 and the daughter board 4 respectively have a plurality of columns of holes defined thereon. Both the mother board 3 and the daughter board 4 are arranged with array of holes in column and row. Each column of the holes defined on the mother board 3 comprises a plurality of first grounding holes 31 and a plurality of first signal hole pairs 32 arranged alternately with the first grounding holes 31. Each column of the holes defined on the daughter board 4 comprises a plurality of second grounding holes 41 and a plurality of second signal hole pairs 42 arranged alternately with the second grounding holes 41.

Figure 2:
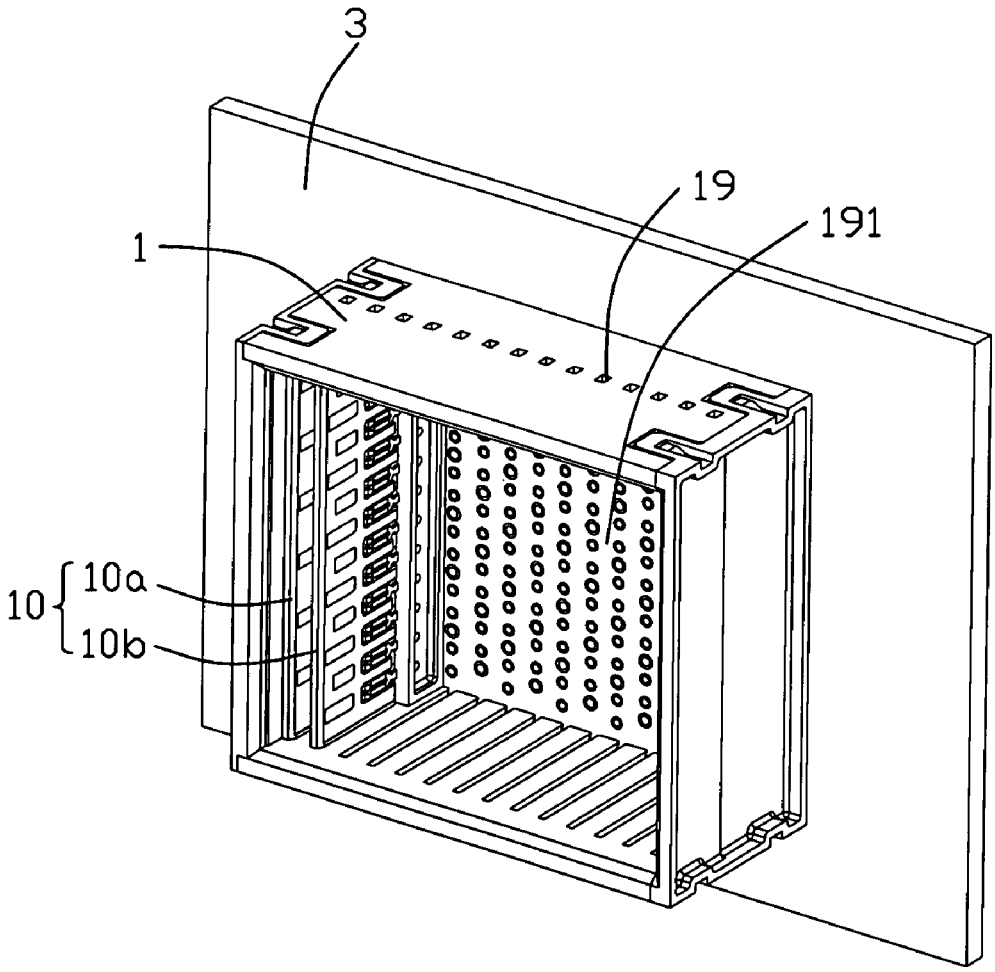
FIG. 2 is a partially assembled perspective view of a female connector and the mother board as shown in FIG. 1, with two female terminal modules inserted in and other female terminal modules left out.
Figure 3:
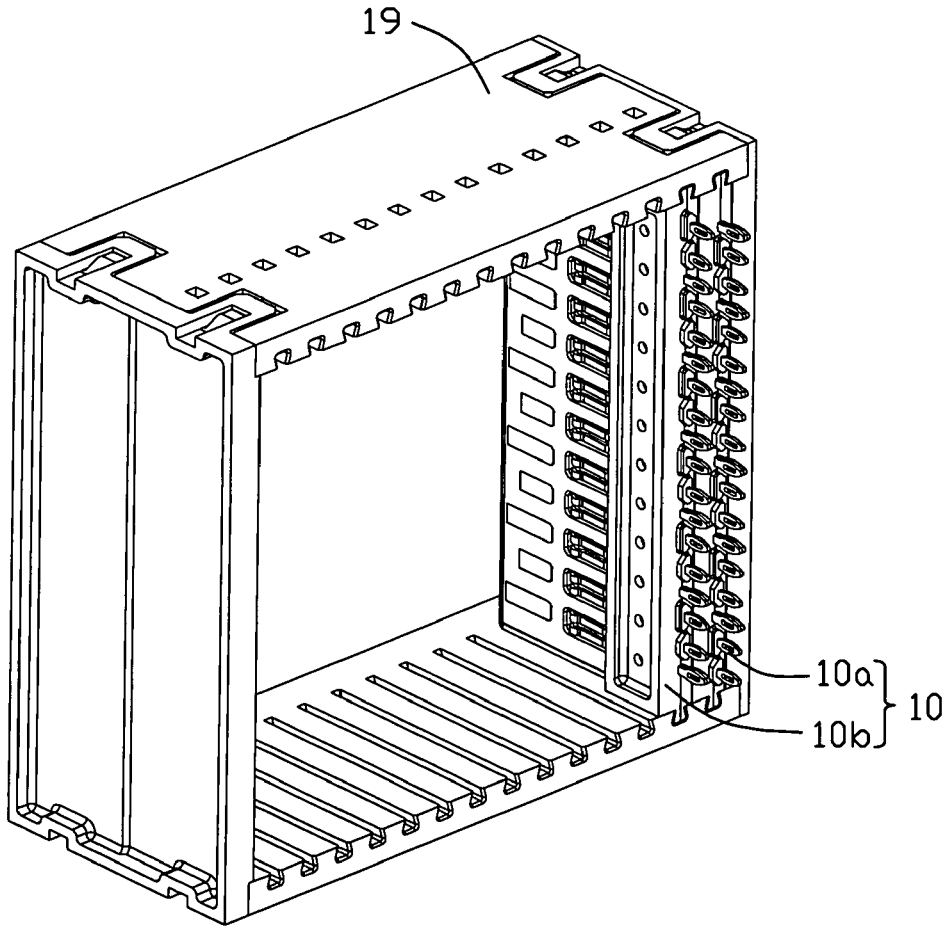
FIG. 3 is a perspective view similar to FIG. 2, with the mother board being removed.

Referring to FIGS. 2-5, the female connector 1 comprises a rectangular female housing 19 defining a receiving cavity 191, a plurality of female terminal modules 10 received in the receiving cavity 191. The plurality of female terminal modules 10 comprises a plurality of first female terminal modules 10*a* and a plurality of second female terminal modules 10*b* arranged alternately with each other. One first female terminal module 10*a* and one second female terminal module 10*b* are shown in FIGS. 2 and 3, with other female terminal modules 10 left out.

Figure 4:
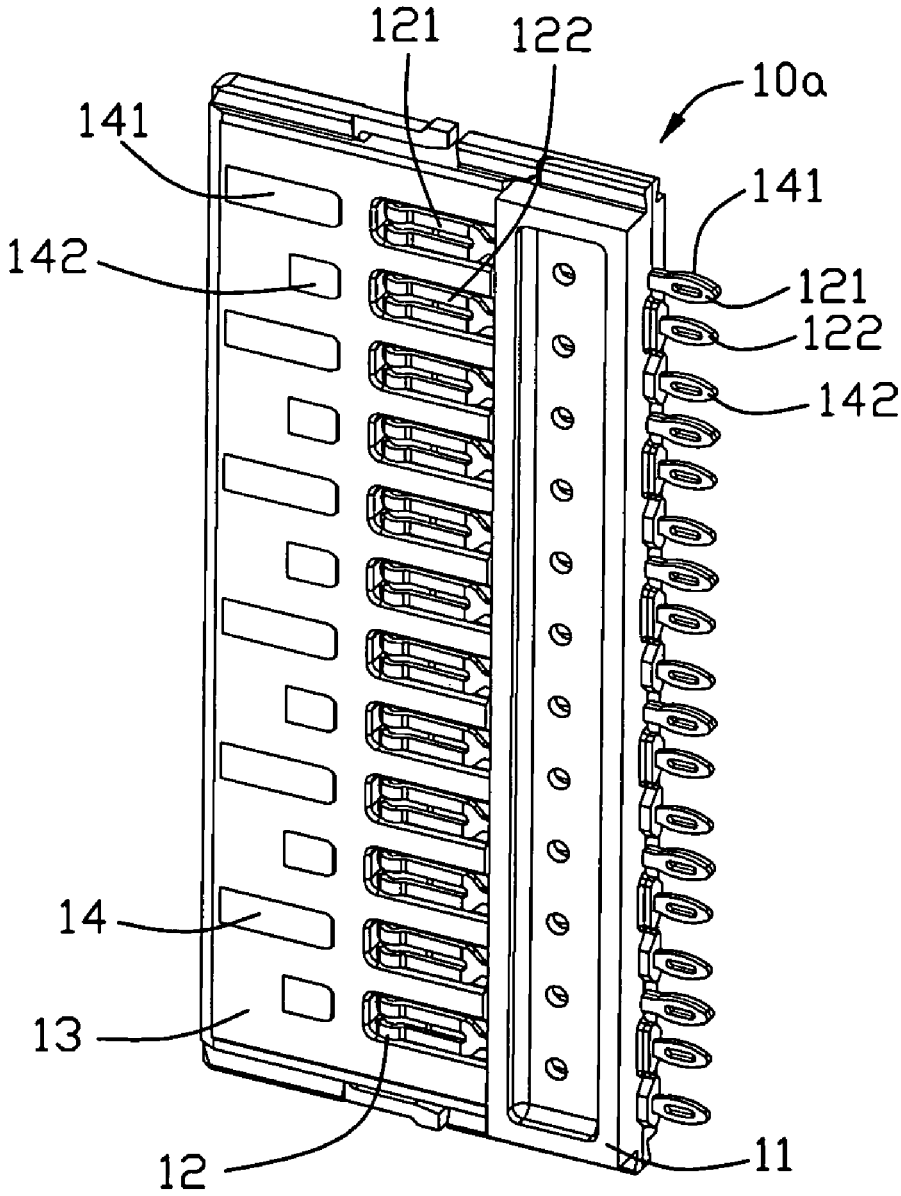
FIG. 4 is an assembled perspective view showing a first female terminal module as shown in FIG. 3.
Figure 5:
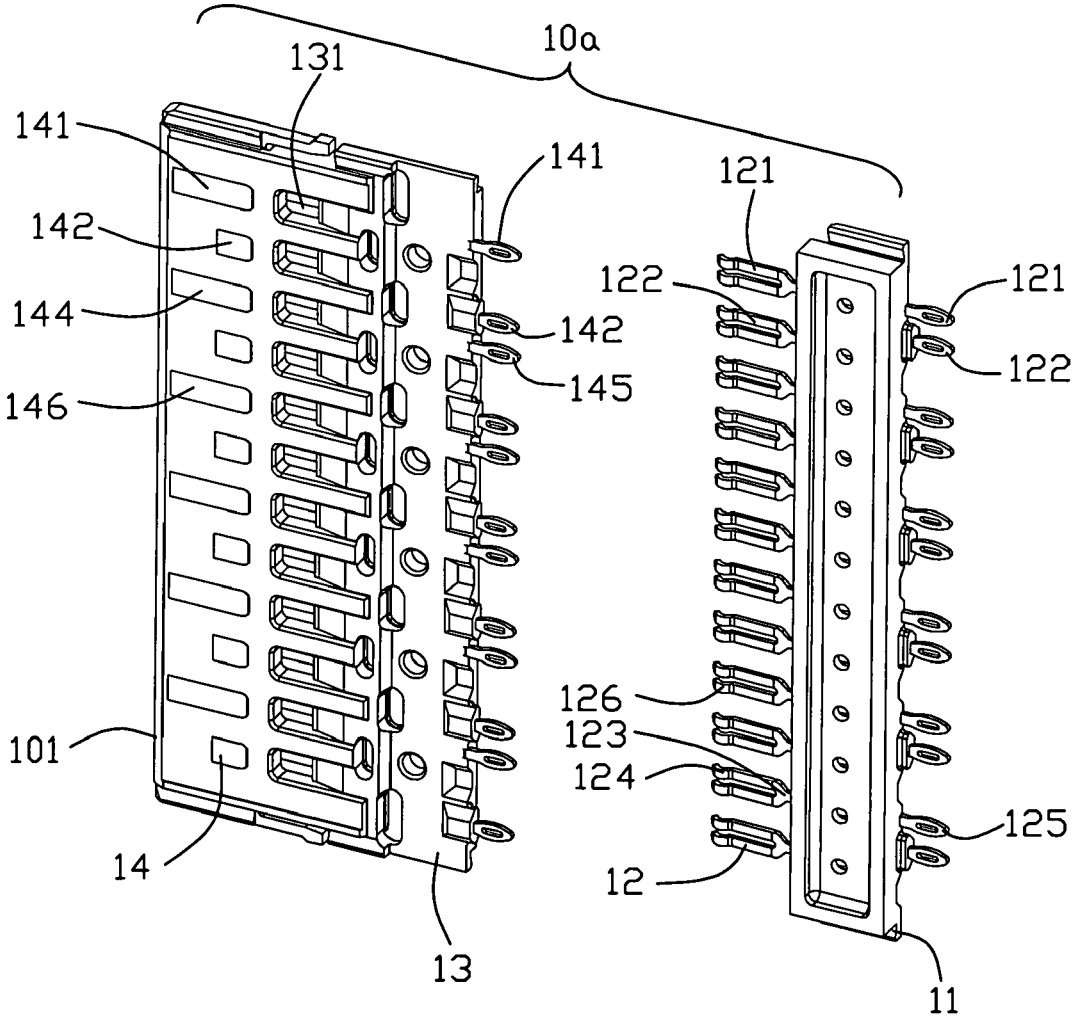
FIG. 5 is a partially exploded perspective view of the first female terminal module as shown in FIG. 4.

Referring FIGS. 4-5, the first female terminal module 10*a* comprises a first female dielectric support or insulative housing 11, a plurality of first female terminals 12 mounted on the first female dielectric support 11, a second female dielectric support 13, and a plurality of second female terminals 14 assembled to the female dielectric support 13. In another embodiment, the first and second female dielectric supports 11 and 13 could be integrated into a whole. The first female terminal 12 comprises a first grounding terminal 121 and a first signal terminal 122 arranged alternately with the first grounding terminal 121 along a vertical direction. Each first female terminal 12 includes a first engaging portion 124, a first tail portion 125 and a first connecting portion 123 connecting with the first engaging portion 124 and the first tail portion 125. The first engaging portion 124 is divided into two separated branches each having an arc-like engaging face 126. The second female terminal 14 comprises a second grounding terminal 141 and a second signal terminal 142 arranged alternately with the second grounding terminal 141 along a vertical direction. In conjunction with FIG. 10, each second female terminal 14 includes a second engaging portion 144, a second tail portion 145 and a second connecting portion 143 connecting with the second engaging portion 144 and the second tail portion 145. The second engaging portion 144 has a rectangular flat engaging face 146. The engaging face 146 of the second grounding terminal 141 has a dimension larger than that of the engaging face 146 of the second signal terminal 142.

In assembling of the first female terminal module 10*a*, the plurality of first female terminals 12 are mounted in the first female dielectric support 11 firstly, with the first connecting portion 123 embedded in the first female dielectric support 11. The first grounding terminals 121 and the first signal terminals 122 are disposed alternately with each other.

Secondly, the second female terminals 14 are embedded in the second female dielectric support 13 by insert molding or other methods, with the second engaging portion 144 exposed on the second female dielectric support 13 and the tail portion 145 exposed outside of the second female dielectric support 13. The second grounding terminals 141 and the second signal terminals 142 are disposed alternately with each other. The second female dielectric support 13 defines a plurality of grooves or recesses 131 aligned with the second engaging portion 144.

Thirdly, the first female dielectric support 11 together with the first female terminals 12 are mounted on the second female dielectric support 13 together with the second female terminals 14 to form the first female terminal module 10*a* as a whole.

At the same time, the tail portions 125 and 145 of the first grounding terminal 121 and the second grounding terminal 141 are disposed in oppose pattern to form themselves as a grounding terminal pair 17. The first grounding terminal 121 and the second grounding terminal 141 are substantially aligned with each other along a traverse direction perpendicular to the vertical direction. The tail portion 125 and 145 of the first signal terminal 122 and the second signal terminal 142 are disposed in jogged pattern to form themselves as a signal terminal pair 18. The first signal terminal 122 and the second signal terminal 142 are substantially aligned with each other along the traverse direction.

Figure 12:
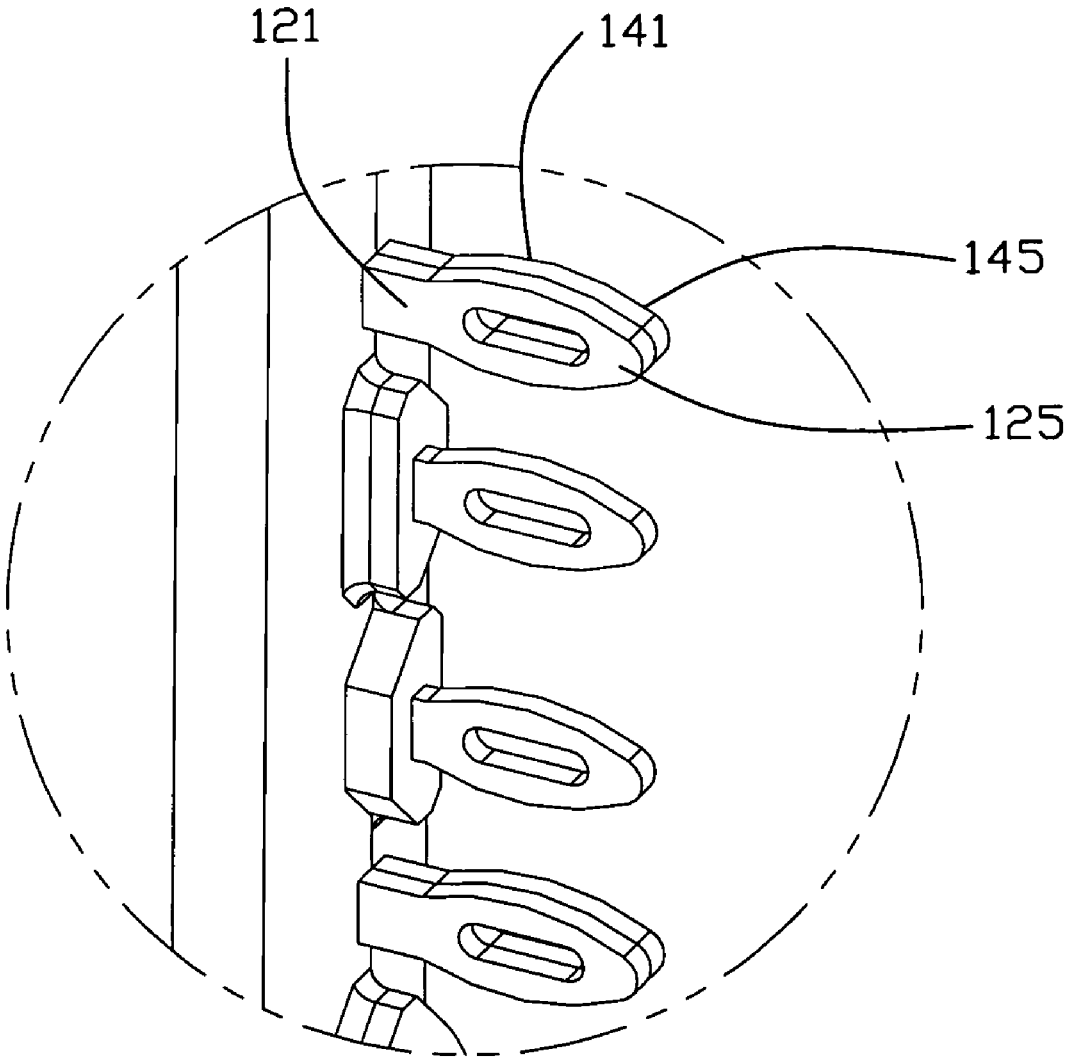
FIG. 12 is a magnifying view showing the overlapped first and second grounding terminals, as especially labeled in FIG. 4.

The first female terminal module 10*a* has a mating edge 101 for mating with the male connector 2. In each first female terminal module 10*a*, compared to the first engaging portions 124 of the first female terminals 12, the second engaging portions 144 of the second female terminals 14 are disposed adjacent to the mating edge 101. The first tail portion 125 of the first grounding terminal 121 and the tail portion 145 of the second grounding terminal 141 are overlapped with each other (see FIG. 12). The first tail portion 125 of the first signal terminal 122 and the tail portion 145 of the second signal terminal 142 are disposed in sequence. The tail portions 125 and 145 of all terminals in one module are substantially arranged in a line and designated as ground-signal-signal sequence.

In conjunction with FIG. 3, the second female terminal module 10*b* has a configuration similar to that of the first female terminal module 10*a*, with the terminal arrangement staggered with that of the first female terminal module 10*a* for reducing crosstalk.

Figure 6:
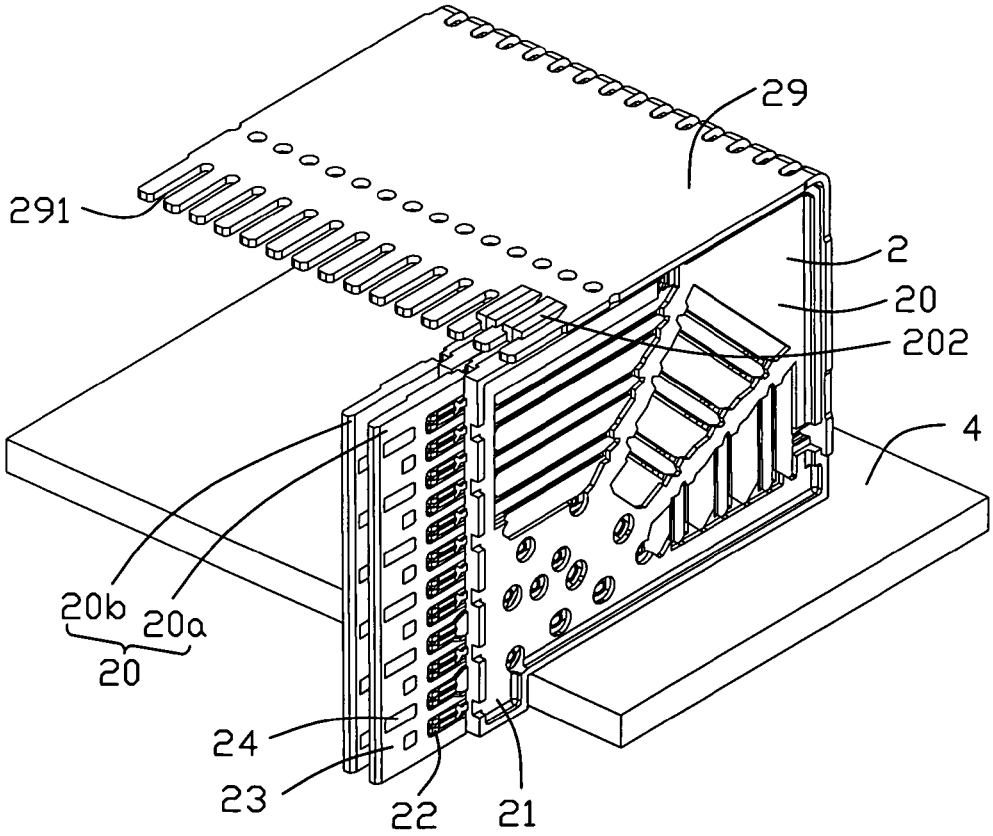
FIG. 6 is a partially assembled perspective view of a male connector and the daughter board as shown in FIG. 1, with two male terminal modules mounted on and other male terminal modules left out.

Referring to FIG. 6, the male connector 2 comprises an L-shaped male housing 29, a plurality of male contact modules 20 secured in male housing 29. The male housing 29 has a plurality of latching recesses 291 for latching with a latching protrusion 202 formed on the male contact modules 20. The male housing 29 could latch with the male contact modules 20 in other manners optionally. The plurality of male contact modules 20 comprise a plurality of first male terminal modules 20*a* and a plurality of second male terminal modules 20*b* arranged alternately with each other. One first male terminal module 20*a* and one second male terminal module 20*b* are shown in FIG. 6, with other male terminal modules 20 left out.

Figure 7:
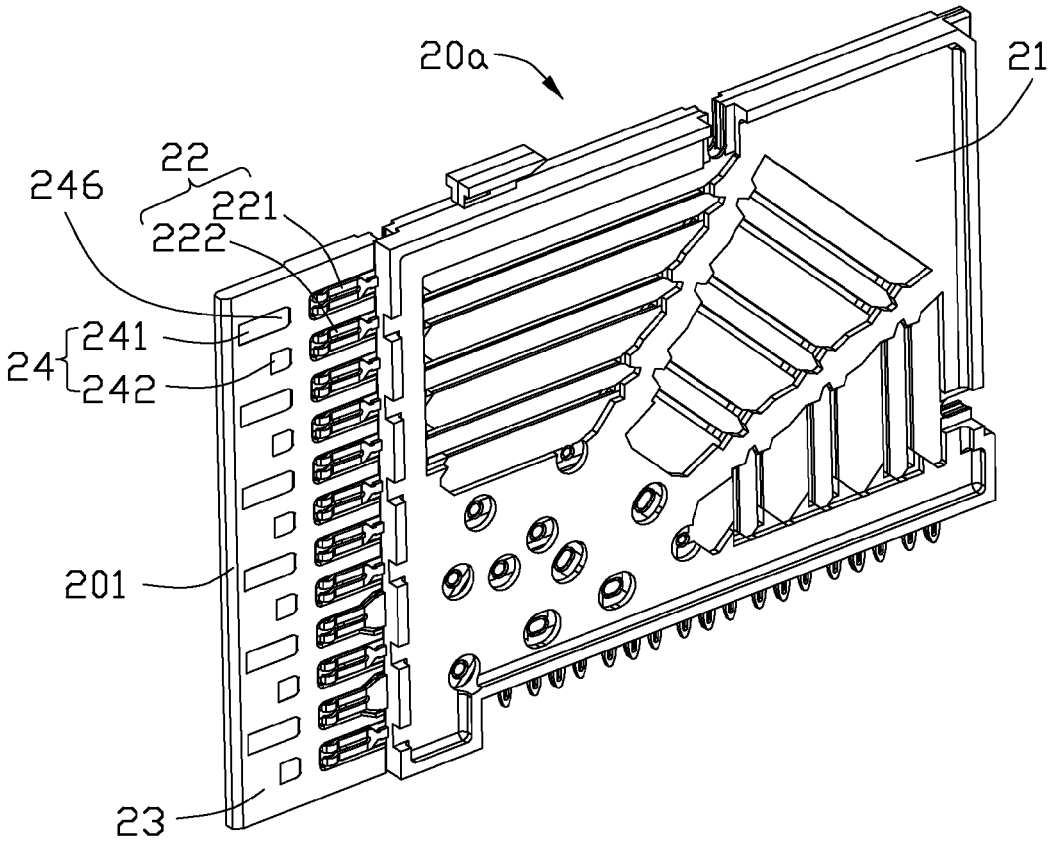
FIG. 7 is an assembled perspective view showing a first male contact module as shown in FIG. 6.
Figure 8:
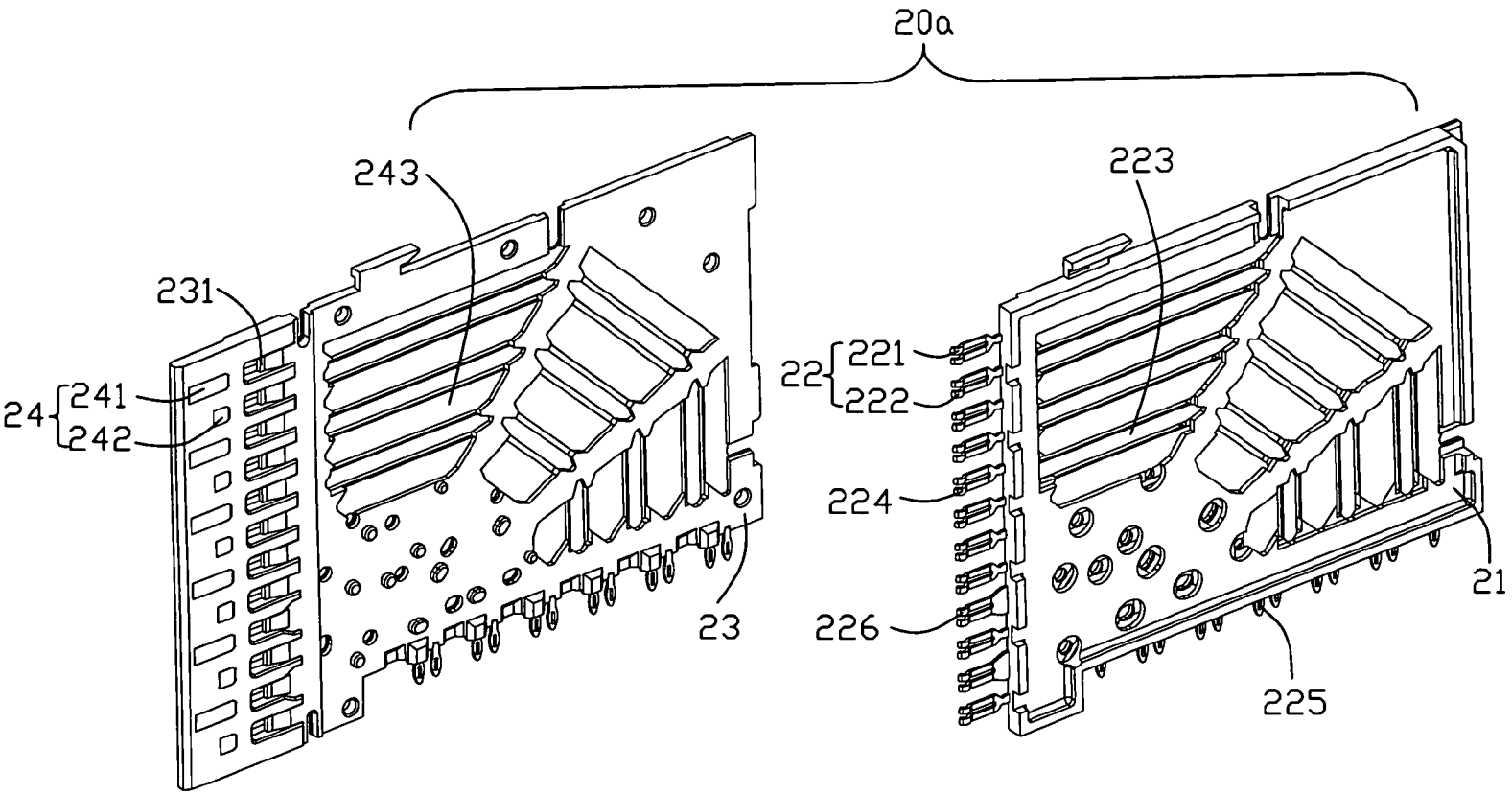
FIG. 8 is a partially exploded perspective view of the first male contact module as shown in FIG. 7.

Referring FIGS. 6-8, the first male terminal module 20*a* comprises a first male wafer 21, a plurality of first male contacts or terminals 22 mounted on the first male wafer 21, a second male wafer 23, and a plurality of second male contacts or terminals 24 assembled to the second male wafer 23. In another embodiment, the first and second male wafers 21 and 23 could be integrated into a whole. The first male contact 22 comprises a first grounding terminal 221 and a first signal terminal 222 arranged alternately along the vertical direction. Each first male contact 22 includes a first contact or engaging portion 224, a first tail portion or tail section 225 and a first body portion 223 connecting with the first contact portion 224 and the first tail section 225. The first contact portion 224 is divided into two separated branches having an arc-like engaging face 226. The second male contact 24 comprises a second grounding contact 241 and a second signal contact 242 arranged alternately along the vertical direction. In conjunction with FIG. 10, each second male contact 24 includes a second contact or engaging portion 244, a second tail section 245 and a second body portion 243 connecting with the second contact portion 244 and the second tail section 245. The second contact portion 244 has a rectangular flat contact face 246.

In assembling of the first male contact module 20*a*, the plurality of first male contacts 22 are mounted in the first male wafer 21 firstly, with the first body portion 223 inserted in the first male wafer 21. The first grounding contacts 221 and the first signal contacts 222 are disposed alternately with each other.

Secondly, the second male contacts 24 are embedded in the second male wafer 23 by insert molding or other methods, with the second contact portion 244 exposed on the second male wafer 23 and the second tail section 245 exposed outside of the second male wafer 23. The second grounding contacts 241 and the second signal contacts 242 are disposed alternately with each other. The second male wafer 23 defines a plurality of grooves 231 aligned with the second contact portions 244.

Thirdly, the first male wafer 21 together with the first male contacts 22 are mounted on the second male wafer 23 together with the second male contacts 24 to form the first male contact module 20*a* as a whole.

At the same time, the first grounding contact 221 and the second grounding contact 241 are disposed in opposing pattern to form themselves as a grounding contact pair 27. The first grounding contact 221 and the second grounding contact 241 are substantially aligned with each other along the traverse direction. The tail sections 225, 245 of the first signal contact 222 and the second signal contact 242 are disposed in jogged pattern to form themselves as a signal contact pair 28. The first signal contact 222 and the second signal contact 242 are substantially aligned with each other along the traverse direction.

The first male contact module 20*a* has a mating side 201 for mating with the first female terminal module 10*a*. In each first male contact module 20*a*, compared to the first contact portions 224 of the first male contacts 22, the second contact portions 244 of the second male contacts 24 are disposed adjacent to the mating side 201. The first tail section 225 of the first grounding contact 221 and the second tail section 245 of the second grounding contact 241 are overlapped with each other. The first tail section 225 of the first signal contact 222 and the second tail section 245 of the second signal contact 242 are disposed in sequence. The tail sections 225, 245 of all contacts in one module are designated as ground-signal-signal sequence and substantially arranged in a line.

The second male contact module 20*b* has a configuration similar to that of the first male contact module 10*b*, with the terminal arrangement of staggered with that of the first male contact module 20*a* for reducing crosstalk.

Referring to FIG. 1, when the male connector 2 is mated with the female connector 1 along a mating direction orthogonal to the mother board 3, the first male contact modules 20*a* are partially overlapped with the first female terminal modules 10*a*, and the second male contact modules 20*b* are partially overlapped with the second female terminal modules 10*b*.

Figure 9:
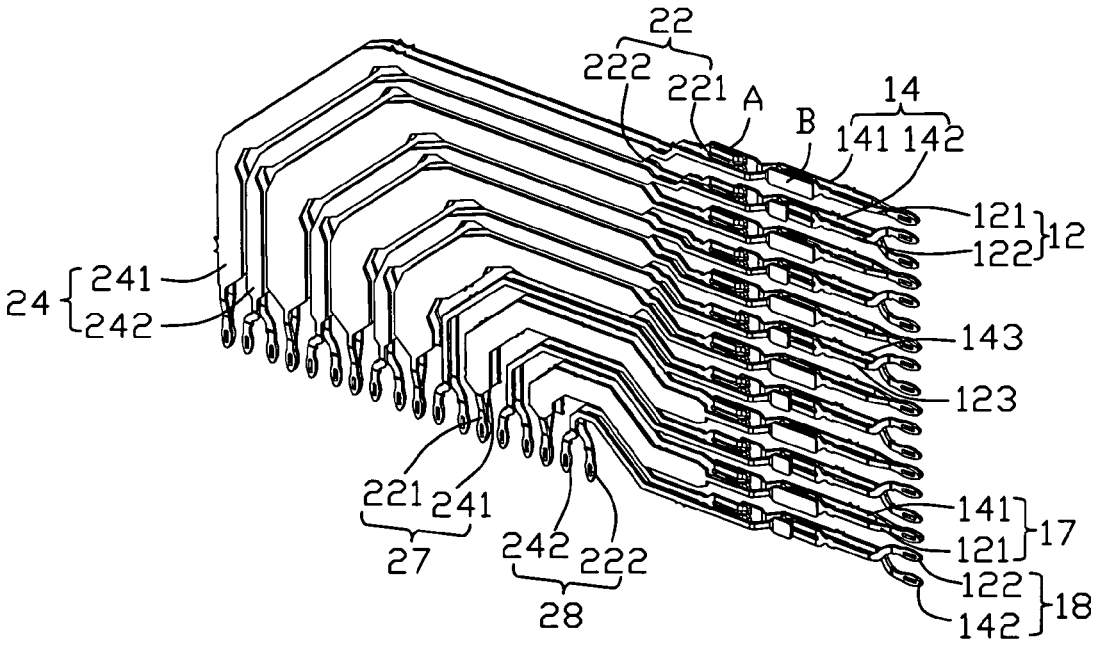
FIG. 9 is a schematic view showing the engagement between the female terminals and the male contacts.
Figure 10:
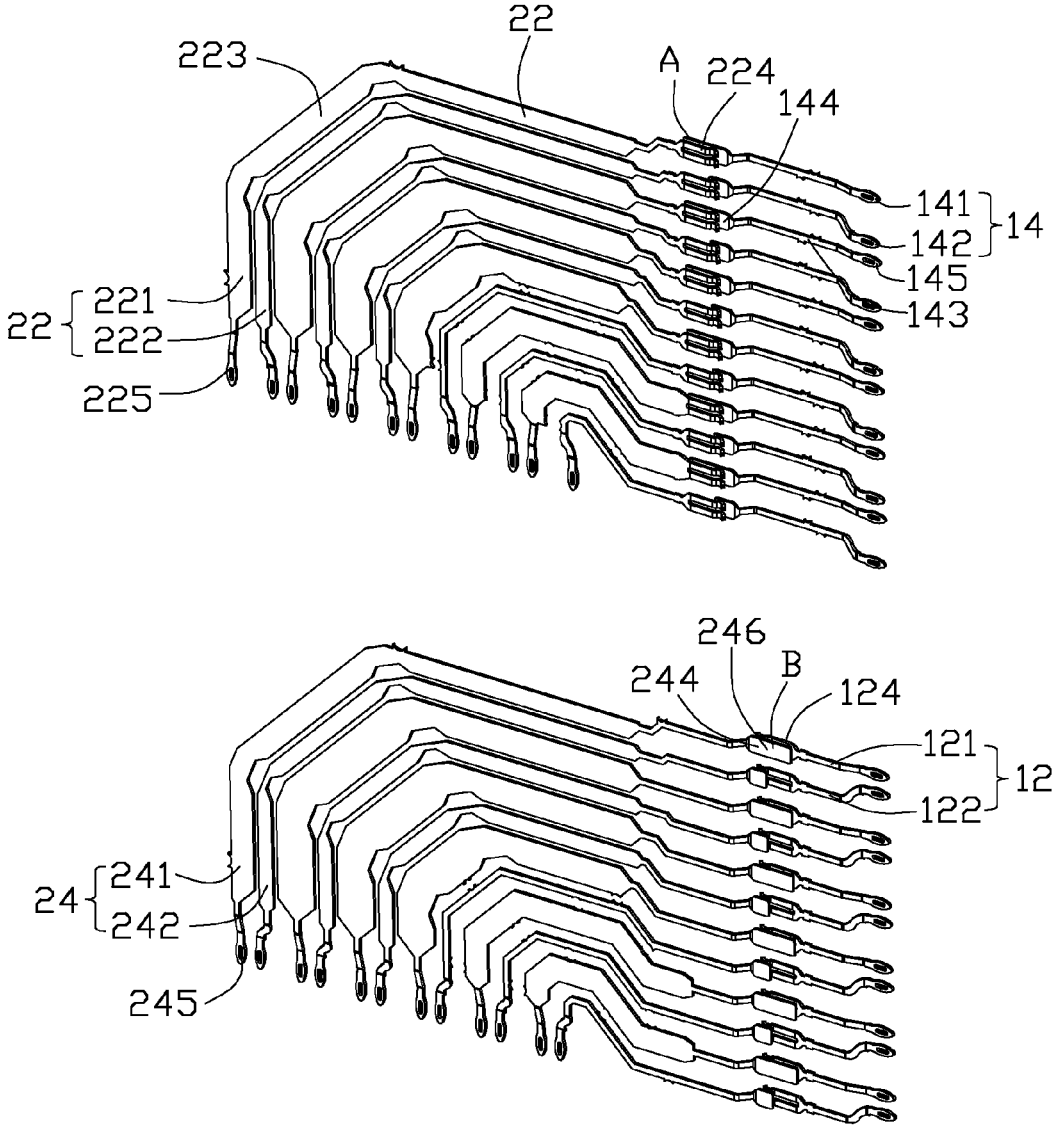
FIG. 10 is a schematic view showing the engagement between the first female terminals and the second male contacts, and the engagement between the second female terminals and the first male contacts.

FIGS. 9-11 show the engagement between the first male contact module 20*a* and the corresponding first female terminal module 10*a*. The first contact portion 224 of the first male contact 22 is in contact with the corresponding second engaging portion 144 of the second female terminal 14 at a first point A. The first points A are arranged in a first line. While the second contact portion 244 of the second male contact 24 is in contact with the first engaging portion 124 of the first female terminal 12 at a second point B. The second points B are arranged along a second line. The first and second lines respectively extend along the vertical direction orthogonal to the daughter board 4. The second line of the second points B is spaced apart from the first line of the first points A along the mating direction. The second point B is aligned with the corresponding first point A along the mating direction. It doesn't need to increase either the thickness of the second dielectric support 13 or the thickness of the second male wafer 23, since the first line of the first points A and the second line of the second points B is not overlapped.

The first tail portion 125 of the first grounding terminal 121 and the second tail portion 145 of the second grounding terminal 141 are overlapped with each other to share a first grounding hole 31 of the mother board 3. The first signal terminal 122 and the second signal terminal 142 are formed as a differential terminal pair, i.e., the signal terminal pair 18, with the first tail portion 125 of the first signal terminal 122 and the second tail portion 145 of the second signal terminal 142 inserted into corresponding first signal hole pair 32 of the mother board 3.

The first tail section 225 of the first grounding contact 221 and the second tail section 245 of the second grounding contact 241 are overlapped with each other to share a same second grounding hole 41 of the daughter board 4. The first signal contact 222 and the second signal contact 242 are formed as a differential contact pair, i.e., the signal contact pair 28, with the first tail section 225 of the first signal contact 222 and the second tail section 245 of the second signal contact 242 inserted into corresponding second signal hole pair 42 of the daughter board 4.

The first grounding contact 221 and the second grounding contact 241 respectively electrically connect with the second grounding terminal 141 and the first grounding terminal 121 for grounding. The first signal contact 222 and the second signal contact 242 respectively electrically connect with the second signal terminal 142 and the first signal terminal 122 for transmitting differential signal.

The length of first grounding terminal 121 plus the length of the second grounding contact 241 is substantially equal to the length of second grounding terminal 141 plus the length of first grounding contact 221. Thus, the transmission path of transmitting grounding signals through the path of first grounding terminal 121 and the second grounding contact 241 is equal to that through the path of the second grounding terminal 141 and the first grounding contact 221. The grounding signal launched at the same time would arrive at the same time via the two paths. Similarly, the length of first signal terminal 122 plus the length of the second signal contact 242 is substantially equal to the length of second signal terminal 142 plus the length of first signal contact 222. The differential signal launched at the same time would arrive at the same time through the second signal contact 242 then the first signal terminal 122, and through the first signal contact 222 then the second signal terminal 142. Designing the twist transmission paths within the wafer or dielectric support allows signals travel through the high density backplane connector 100 synchronously.

The grounding path and the signal path are arranged alternately in the high density backplane connector 100. The ratio of grounding path and the signal path is one vs one. It helps to improve crosstalk performance. Optionally, the ratio of the signal path and the grounding path could be increased, with the crosstalk performance being unimproved.

Referring to FIG. 11, the first tail portion 125 of the first grounding terminal 121 and the second tail portion 145 of the second grounding terminal 141 share the first grounding hole 31 of the mother board 3. The first tail section 225 of the first grounding contact 221 and the second tail section 245 of the second grounding contact 241 share the second grounding hole 41 of the daughter board 4. Board density is not sacrificed.

Referring to FIGS. 9 and 11, in each differential terminal pair 18, 28, the first tail portion 125 of the first signal terminal 122 and the second tail portion 145 of second signal terminal 142 respectively orient toward opposite directions from corresponding first, second connecting portions 123, 143 to form the first, second tail portions 125, 145 into a "Y" shape. The first and second tail portions 125, 145 of the first and second signal terminals 122, 142 are arranged into a first column. The first, second tail portions 125, 145 of the first and second grounding terminals 121, 141 are overlapped and arranged along the first column too. The first, second tail portions 125, 145 in a same first female terminal module 10*a* arranged along a same column would result in space saved. The arrangement of the first and second tail sections 225, 245 is similar to that of the first, second tail portions 125, 145.

The disclosure is illustrative only, changes may be made in detail, especially in matter of shape, size, and arrangement of parts within the principles of the invention.

What is claimed is:

1. A connector comprising:

a housing comprising a first insulative housing and a second insulative housing attachable to the first insulative housing; and a plurality of wafers assembled within said housing, each wafer comprising:

a first set of contacts including a first and a second contacts arranged within the first insulative housing having a mating end and a mounting end, each of the first and second contacts respectively including a first and a second contact engaging portions, and a first and a second mounting portions, wherein the first and second contact engaging portions are located adjacent to an edge of the mating end; and a second set of contacts including a third and a fourth contacts corresponding to each of the first and second contacts and arranged in said second insulative housing, each of the third and fourth contacts including a third and a fourth contact engaging portions and a third and a fourth mounting portions; and wherein when the second insulative housing is attached to the first insulative housing, the third and the fourth contact engaging portions are located in a position which is in aligning with the first and second contact engaging portions respectively, and located in a position away from the edge of the mating end, wherein said first contacts and second contacts are arranged to be spaced from one another in a first imaginary plane and said third and fourth contacts are arranged to be spaced from one another in a second imaginary plane, said first contact and associated third contact being spaced from and aligned with each other along a direction perpendicular to said parallel first and second imaginary planes, said first through fourth mounting portions being arranged substantially in a line in a third imaginary plane parallel to the first and second imaginary planes.

2. The connector as claimed in claim 1, wherein said first and the third contacts, the second and the fourth contacts are respectively configured as a differential contact pair.

3. The connector as claimed in claim 1, wherein said first insulative housing defines a first and a second recesses each receiving the third and the fourth engaging portions therein respectively.

4. The connector as claimed in claim 3, wherein said first, second, third and fourth contact engaging portions are disposed substantially in a common plane.

5. The connector as claimed in claim 1, wherein said second and fourth mounting portions are offset from each other while located in the same line.

6. The connector as claimed in claim 1, wherein said first contact engaging portion is blade type contact engaging portion, and the fourth contact engaging portion is beam-type contact engaging portion.

7. The connector as claimed in claim 1, wherein said first contact engaging portion is substantially larger than the second contact engaging portion.

8. The connector as claimed in claim 1, wherein said first contact engaging portion is closer to the mating end than the second contact engaging portion.

9. The connector as claimed in claim 1, wherein said first mounting portion and the third mounting portion are arranged together.

10. The connector as claimed in claim 1, wherein each wafer within the same housing has a terminal arrangement, the terminal arrangements of two adjacent wafers being staggered from each other.

11. A terminal arrangement in an electrical connector comprising:

a group of terminal pairs each including a first terminal and a second terminal, said first terminals of said group of terminal pairs being arranged to be spaced from one another in a first imaginary plane and said second terminals of said group of terminal pairs being arranged to be spaced from one another in a second imaginary plane closely parallel to said first imaginary plane, wherein said first terminal and said second terminal in each terminal pair substantially are spaced from and aligned with each other along a direction perpendicular to said parallel first and second imaginary planes, the first terminal having a first engaging portion and a first tail portion, the second terminal having a second engaging portion and a second tail portion, the first and second tail portions of the terminal pairs being arranged substantially in a line in a third imaginary plane parallel to said first and second imaginary planes in said direction, said first terminals of the group of terminal pairs being electrically isolated from each other in said first imaginary plane, said second terminals of the group of terminal pairs being electrically isolated from each other in said second imaginary plane.

12. The terminal arrangement as claimed in claim 11, wherein said second engaging portion extends beyond the first engaging portion.

13. The terminal arrangement as claimed in claim 12, wherein said first engaging portion of the first terminal has a flat surface; and the second engaging portion of the second terminal has a curved surface.

14. The terminal arrangement as claimed in claim 12, wherein said group of terminal pairs comprise grounding terminal pairs and signal terminal pairs arranged alternately along each of said first and second planes, said first and second tail portions of the terminal pairs being designated as ground-signal-signal sequence essentially in said third plane.

15. The terminal arrangement as claimed in claim 14, wherein said first and second tail portions of the grounding terminal pair are overlapped in said direction, and said first and second tail portions of the signal terminal pair are spaced apart from each other in said third plane which is located between the first imaginary plane and the second imaginary plane.

16. The terminal arrangement as claimed in claim 11, wherein said group of terminal pairs are categorized with grounding terminal pairs and signal terminal pairs arranged alternately in each of said first and second imaginary planes, said first and second tail portions of the terminal pairs being designated as ground-signal-signal sequence essentially in said third imaginary plane which is specifically arranged different from said first imaginary plane and said second imaginary plane and located between the first imaginary plane and the second imaginary plane; wherein the first terminals of both said grounding terminal pairs and said signal terminal pairs are disposed in a first module and the second terminals of both said grounding terminal pairs and said signal terminal pairs are disposed in a second module stacked with the first module in said direction.

17. A contact system comprising:

a first terminal pair arranged in side-by-side, and each first terminal pair comprising a first set of mounting tails located in a first common line while offsetting from each other; and a second terminal pair arranged adjacent to the first terminal pair, and comprising a second set of mounting tails converged together, wherein said first terminal pair comprises a first terminal arranged in a first imaginary plane and a second terminal arranged in a second imaginary plane, said first terminal and associated second terminal being spaced from and aligned with each other along a direction perpendicular to said parallel first and second imaginary planes, said mounting tails of the first and second terminals being arranged substantially in said first common line, said first common line disposed in a third imaginary plane parallel to the first and second imaginary planes, said second terminal pair aligning with said first terminal pair along another direction parallel to said first common line.

18. The contact system as claimed in claim 17, wherein each of the first terminal pair comprises a first set of contact engaging portions arranged in a second common line and configured different from each other, one of said first set of contact engaging portions and corresponding one of said first set of mounting tails being respectively disposed at opposite ends of either one of said first terminal and said second terminal.

19. The contact system as claimed in claim 17, wherein said first and second terminals of the first terminal pair are arranged in a first connector and have a length different from each other; and said second terminal pair comprises a third and a fourth terminals arranged within the second connector each having a length different from each other, a total length of first and third terminals being substantially equal to a total length of the second and fourth contact terminals.

20. The contact system as claimed in claim 19, wherein said first and third terminals respectively has a first and a third contact portions engaging with each other at a first line; and said second and fourth terminals respectively has a second and a fourth contact portions engaging with each other at a second line, said second line being parallel to the first line and spaced apart from the first line.

* * * * *